US006653039B2

(12) United States Patent
Tomita

(10) Patent No.: US 6,653,039 B2
(45) Date of Patent: Nov. 25, 2003

(54) TONER, AND ELECTROPHOTOGRAPHIC IMAGE FORMING METHOD AND APPARATUS USING THE TONER

(75) Inventor: Kunihiko Tomita, Kanagawa-ken (JP)

(73) Assignee: Ricoh Company Limited, Tokyo (JP)

( * ) Notice: Subject to any disclaimer, the term of this patent is extended or adjusted under 35 U.S.C. 154(b) by 0 days.

(21) Appl. No.: 10/133,754

(22) Filed: Apr. 29, 2002

(65) Prior Publication Data

US 2003/0031947 A1 Feb. 13, 2003

(30) Foreign Application Priority Data

Apr. 27, 2001 (JP) ..... 2001-132836
Jun. 25, 2001 (JP) ..... 2001-191326

(51) Int. Cl.[7] ..... G03G 9/087

(52) U.S. Cl. ..... 430/109.3; 430/108.1; 430/108.8; 430/124; 399/297

(58) Field of Search ..... 430/109.3, 108.1, 430/108.8, 124; 399/297

(56) References Cited

U.S. PATENT DOCUMENTS 4,473,629 A * 9/1984 Herrmann et al. ..... 430/114
4,555,466 A * 11/1985 Okada et al. ..... 430/106.6
5,220,383 A 6/1993 Enoki et al.
5,245,391 A 9/1993 Suzuki et al.
5,311,263 A 5/1994 Suzuki et al.
5,339,141 A 8/1994 Suzuki et al.
5,424,814 A 6/1995 Suzuki et al.
5,450,172 A 9/1995 Suzuki et al.
5,502,552 A 3/1996 Iwata et al.
5,527,657 A 6/1996 Takeda et al.
5,541,029 A 7/1996 Iwata et al.
5,557,392 A 9/1996 Iwata
5,809,386 A 9/1998 Iwata
5,812,917 A 9/1998 Iwata et al.
5,869,213 A 2/1999 Iwata et al.
6,370,350 B2 4/2002 Tomita et al.
6,370,352 B1 4/2002 Tomita

FOREIGN PATENT DOCUMENTS

JP 62-266562 11/1987
JP 63-050865 3/1988
JP 63-108357 5/1988
JP 63-108358 5/1988
JP 63-108359 5/1988
JP 63-113560 5/1988
JP 02-248959 10/1990
JP 07-271100 10/1995
JP 2548091 8/1996

* cited by examiner

*Primary Examiner*—John Goodrow
(74) *Attorney, Agent, or Firm*—Oblon, Spivak, McClelland, Maier & Neustadt, P.C.

(57) ABSTRACT

A toner which includes at least a colorant and a binder including at least a cyclized polybutadiene and a trans 1,4-polybutadiene, in which the cyclized polybutadiene is mixed with the trans 1,4-polybutadiene at a temperature not lower than a melting point of the trans 1,4-polybutadiene.

50 Claims, 1 Drawing Sheet

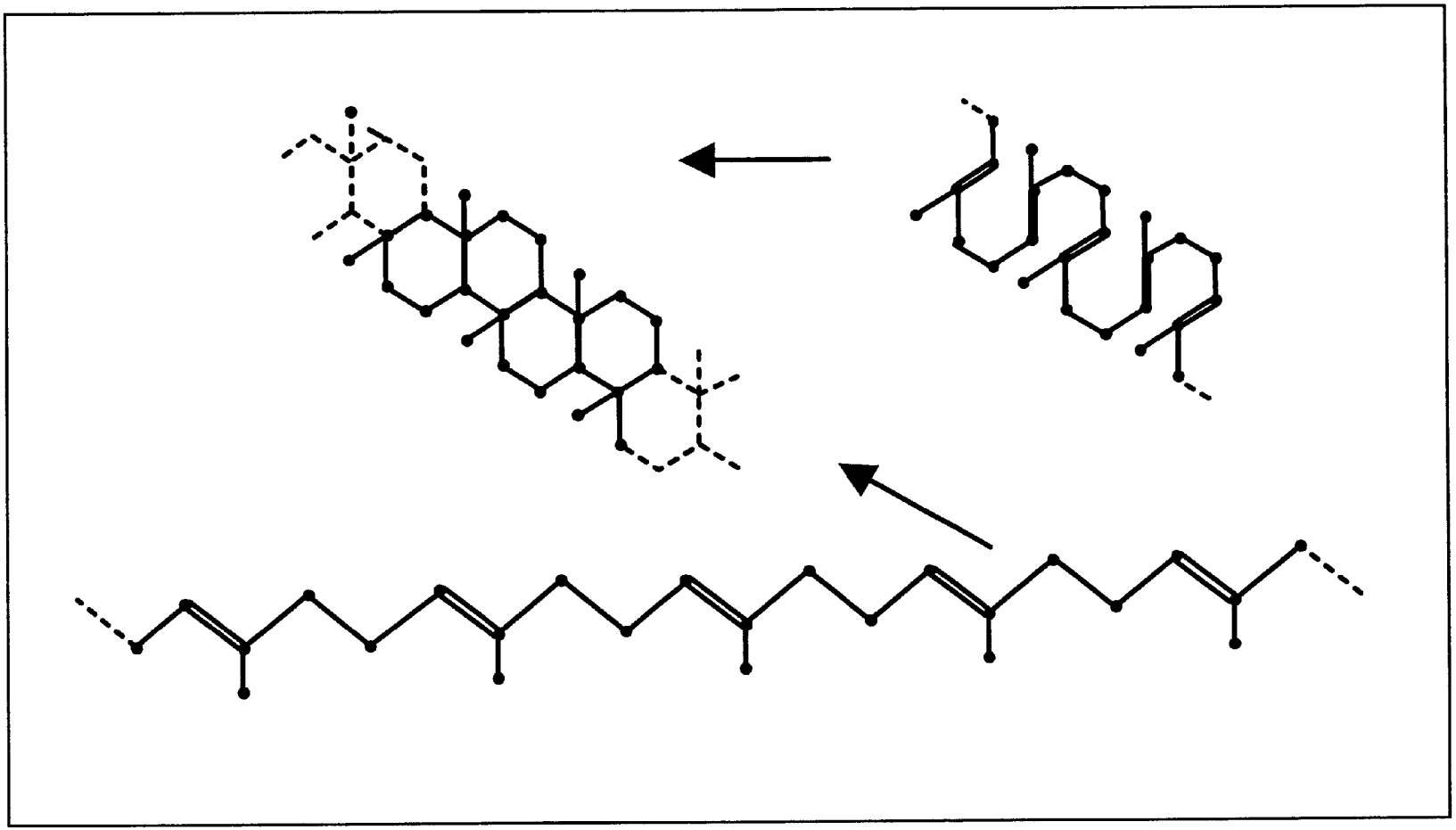

TONER, AND ELECTROPHOTOGRAPHIC IMAGE FORMING METHOD AND APPARATUS USING THE TONER

BACKGROUND OF THE INVENTION

1. Field of the Invention

The present invention relates to a toner used for electrophotographic copiers, facsimiles and printers.

2. Discussion of the Background

Conventionally, a heat fixation is mostly used for fixing a toner. A principle of the heat fixation of a toner is that the toner is softened or melted by a heat of a fixer and enters among fibers of a paper by a pressure of the fixer, or adheres onto the paper due to an adhesive surface of the softened or melted toner. Therefore, a resin used for a toner has to have a melting or softening point lower than the temperature of a fixer.

However, a demand for saving energy for a protection of the global environment is growing recently and an energy consumed for fixing a toner is becoming limited. Practically, the temperature of the fixer has to be decreased in order to decrease the fixing energy. Therefore, a resin for a toner which can be used for a fixer having such a low temperature inevitably has a low melting point. However, a resin having such a low melting point is easily softened and blocked after processed for a toner. In addition, an interaction of the resin with an external additive of a toner changes with age since the surface of the resin is adhesive, resulting in change of properties and poor preservability of the toner. Further, in an image developer, problems such as toner-spent to a carrier in a two-component developer, toner filming over the developing roller and toner adherence to the developing blade occur since the toner is soft and adhesive. Receptor papers even after printed tend to have blocking due to a change of the environment. Besides these problems, there are problems in a process of manufacturing a toner such as low pulverizability and adherence of the toner onto the inside surface of a pulverizer in a pulverizing process because a conventional resin having a low melting point is too soft.

Because of these reasons, a need exists for a toner which does not have the above-mentioned problems.

SUMMARY OF THE INVENTION

Accordingly, an object of the present invention is to provide a toner which can be fixed at a temperature lower than that of a conventional toner to save energy, and which have the following properties:

(a) good preservability;

(b) no change of an interaction of a resin included in the toner with an external additive thereof;

(c) no toner-spent, filming and adherence;

(d) imparting good preservability to printed receptor materials; and (e) good pulverizability.

Briefly this object and other objects of the present invention as hereinafter will become more readily apparent can be attained by a toner capable of fixing at a temperature not greater than a melting point of cyclized polybutadiene which is used as a main binder and dissolved by trans 1,4-polybutadiene at a temperature not less than a melting point thereof.

In addition, the cyclized polybutadiene and the trans 1,4-polybutadiene of the present invention can be substituted by a cyclized rubber and an after-mentioned wax, respectively.

These and other objects, features and advantages of the present invention will become apparent upon consideration of the following description of the preferred embodiments of the present invention taken in conjunction with the accompanying drawing.

BRIEF DESCRIPTION OF THE DRAWING

Various other objects, features and attendant advantages of the present invention will be more fully appreciated as the same becomes better understood from the detailed description when considered in connection with the accompanying drawing in which like reference characters designate like corresponding parts throughout and wherein:

FIGURE is a schematic view illustrating an embodiment of a reaction to form the cyclized polybutadiene of the present invention.

DETAILED DESCRIPTION OF THE INVENTION

Generally, the present invention provides a toner capable of fixing at a temperature lower than that of a conventional toner, having the following properties:

(a) good preservability;

(b) no change of an interaction of a resin included in the toner with an external additive thereof;

(c) no toner-spent, filming and adherence;

(d) imparting good preservability to printed receptor materials; and (e) good pulverizability.

Basically, in the present invention, cyclized polybutadiene having a high melting point is used as a main binder, which has good preservability, spent resistance, filming resistance and adherence resistance. The cyclized polybutadiene is dissolved by trans 1,4-polybutadiene and solidified to form a toner. When the toner is fixed upon application of heat, the cyclized polybutadiene is dissolved by the trans 1,4-polybutadiene at a temperature not less than a melting point thereof. Then, the cyclized polybutadiene is softened or melted to be fixable before the temperature reaches a melting point thereof. In addition, a resin mixed with the cyclized polybutadiene is not too soft because the cyclized polybutadiene has a high melting point, and the resin has good pulverizability.

When the cyclized polybutadiene is mixed with a conventional resin for use as a binder, the cyclized polybutadiene has to have a content at least 10% by weight per 100% by weight of the binder. When the cyclized polybutadiene has a content less than 10% by weight, the resultant toner does not have a sufficiently low melting point and is not well fixed. The cyclized polybutadiene preferably has a content of from 15 to 50% or more by weight.

The more a composition ratio of the trans 1,4-polybutadiene to the cyclized polybutadiene, the lower a dissolved viscosity of the cyclized polybutadiene. When a composition ratio of the cyclized polybutadiene is decreased, the trans 1,4-polybutadiene does not dissolve the other reins and is not mixed therewith. Therefore, the resin and the trans 1,4-polybutadiene are separated from each other and difficult to become a toner. When the weight ratio of the cyclized polybutadiene is too high and that of the trans 1,4-polybutadiene is too low, the dissolved viscosity of the cyclized polybutadiene is too high to be fixable even if the cyclized polybutadiene is dissolved by the trans 1,4-polybutadiene. As a result of an investigation of the present inventor, an effect of the present invention is exerted when the weight ratio between the cyclized polybutadiene and the trans 1,4-polybutadiene is from 97/3 to 5/95. However, in a practical use, a toner is fixed not only in an air-conditioned office but also in various environments such as high temperature, high humidity, low temperature and low humidity. Therefore, the weight ratio between the cyclized polybutadiene and the trans 1,4-polybutadiene is preferably from 95/5 to 20/80, and more preferably from 80/20 to 40/60.

Unless the trans 1,4-polybutadiene has a melting point lower than that of the cyclized polybutadiene, the cyclized polybutadiene naturally cannot be dissolved by the trans 1,4-polybutadiene at a temperature lower than the melting point of the cyclized polybutadiene and a melting point of the resultant toner cannot be decreased. Therefore, the trans 1,4-polybutadiene is preferably used as a solvent for the cyclized polybutadiene.

In addition, the trans 1,4-polybutadiene can be substituted by an after-mentioned wax, and when the wax is used, the wax preferably has a melting point of 50 to 130° C., and more preferably from 50 to 90° C. The lower the melting viscosity of the wax, the better the performance of the wax in the present invention. However, a wax having a melting viscosity lower than 1 c poise is unknown. When a wax having a high melting viscosity is used for dissolving the cyclized polybutadiene, the wax solution of the cyclized polybutadiene has a viscosity higher than 10,000,000 c poise and the resultant toner tend to have a poor fixability. Further, in a practical use, a toner is fixed not only in an air-conditioned office but also in various environments such as high temperature, high humidity, low temperature and low humidity. Therefore, the wax preferably has a melting viscosity of 1 to 100,000, and more preferably from 1 to 100 c poise. Accordingly, a wax having a melting viscosity of from 1 to 10,000,000 c poise at a temperature of 150° C. can be preferably used.

In addition, the wax preferably has a penetration of from 0 to 20 at 25° C. Namely, typically when a wax has a high penetration, the wax itself has high adherence, resulting in toner spent, filming and adherence. In an environment of high temperature, the wax more preferably has a penetration of from 0 to 5.

Typically, waxes such as paraffin waxes having a straight chain; and a microcrystalline waxes, olefin waxes, fatty acids, aliphaticketone, amine, amide, alcohol, sterol, having branched chains, etc. are available. These are after all a combination or a group of a part of a molecule and their main parts of alkyl groups are so long that the total polarity is extremely low. However, specific examples of the wax for use in the present invention include paraffin waxes and microcrystalline waxes or oxides of the waxes, montanic acids, montanic acid esters, carnauba waxes, candelilla waxes, rice waxes, esparto waxes, castor waxes, Japan waxes, bee waxes, jojoba oils, sterols, ketone, etc. Particularly, paraffin waxes, microcrystalline waxes and olefin waxes or oxides of these waxes are preferably used in the present invention. These waxes dissolve the cyclized polybutadiene in a short time when a toner is manufactured. This is because the polarity of these waxes is considered to be low enough to have a good affinity with an annulation of the cyclized polybutadiene.

As a result of an investigation of the present inventor, a good effect of the cyclized polybutadiene is exerted when the cyclized polybutadiene has a cyclization ratio not less than 40%.

When the cyclization ratio is low, the cyclized polybutadiene discloses its original nature as a rubber and pulverizability thereof significantly deteriorates. When the cyclization ratio is about 30%, the cyclized polybutadiene is soft and has a nature of a liquid. Therefore, the cyclized polybutadiene preferably has a cyclization ratio not less than 70%.

Even a synthetic solvent of the trans 1,4-polybutadiene occasionally includes by-products such as cis 1,4-polybutadiene, isotactic-1,2-polybutadiene and syndiotactic-1,2-polybutadiene. The solvent needs to have a content of trans 1,4-polybutadiene not less than 60% by weight, and preferably from 70 to 90% or more.

When the trans 1,4-polybutadiene is so strong that the resultant toner does not have good pulverizability, the pulverizability is improved if a wax and a resin are mixed at a weight ratio of from 1/99 to 50/50, and preferably from 5/95 to 30/70.

When the wax has a high penetration, the resultant toner has a high agglomerating property, resulting in significant deterioration of thin-layer formability and fed performance thereof. The wax preferably has a penetration of from 0 to 20, and more preferably from 0 to 5.

In order to solve the problems of the conventional technologies, it was discovered in the present invention that:

(1) a resin having a melting point higher than the minimum temperature for fixing a toner and trans 1,4-polybutadiene having a melting point lower than the minimum temperature therefor are used; and (2) the trans 1,4-polybutadiene softens or dissolves the resin at a molecular level as a solvent or a plasticizer at a temperature not less than the melting point of the trans 1,4-polybutadiene and the resin becomes fixable.

Thus, the resultant toner becomes fixable at a temperature close to the melting point of the trans 1,4-polybutadiene, which is far lower than a melting point of the resin practically used, to save energy. In addition, even when the cyclized polybutadiene having a high melting point is used, the resultant toner is fixable at a low temperature.

The melting point of a resin in the present invention is a softening point when measured by a flow tester method. For example, the cyclized polybutadiene has an endothermic peak between 50° C. and 80° C. when measured by a differential scanning calorimeter method, but it practically appears a solid even at 100° C.

Japanese Laid-Open Patent Publication No. 7-271100; Japanese Patent Publications Nos. 7-15596, 7-31418, 7-40146, 7-62465, 7-82248, and 7-104612; and Japanese Patents Nos. 2548091 and 2759482 disclose similar inventions. However, these are all used for forming a shell, i.e., a capsule forming agent to fold a dispersion stabilizer when forming a suspension polymerized toner or a polymerized resin having a low softening point for a purpose of preventing blocking when forming a polymerized toner. Therefore, these are basically and completely different inventions from the present invention.

The cyclized polybutadiene is formed by a reaction as shown in the FIGURE. As examples of manufacturing method thereof, the following methods are available.

In Fisher's method, a rubber in which 5% by weight of a strong sulfuric acid has been kneaded is heated for 15 hrs at 130° C. to form a cyclized polybutadiene. Preferably, the rubber is a polybutadiene rubber having a number average molecular weight of from $5\times10^3$ to $3\times10^5$. Besides this method, there are methods in which organic sulfonic acids; tin chloride; iron chloride; non-metallic halogenated compounds and halogenated primary and secondary stannic acids, etc. are used as a cyclizer to form various resinoid plastic substances.

As shown in the FIGURE, these are isomerized by an oxidant, and the specific gravity increases and the degree of unsaturation decreases to form a substance having quite a different nature. The cyclized polybutadiene of the present invention can be formed in such a method.

As a sub-resin for the toner of the present invention, the following resins can be used.

Specific examples of a binder resin used for the toner include styrene and its substituted polymers such as polystyrene, poly-p-chlorostyrene and polyvinyltoluene; styrene copolymers such as styrene-p-chlorostyrene copolymers, styrene-propylene copolymers, styrene-vinyltoluene copolymers, styrene-vinylnaphthalene copolymers, styrene-methylacrylate copolymers, styrene-ethylacrylate copolymers, styrene-butylacrylate copolymers, styrene-octylacrylate copolymers, styrene-methylmethacrylate copolymers, styrene-ethylmethacrylate copolymers, styrene-butylmethacrylate copolymers, styrene-α-methylchloromethacrylate copolymers, styrene-acrylonitrile copolymers, styrene-vinyl methyl ketone copolymers, styrene-butadiene copolymers, styrene-isoprene copolymers, styrene-acrylonitrile-indene copolymers, styrene-maleate copolymers and styrene-ester maleate copolymers; polymethylmethacrylate; polybutylmethacrylate; polyvinylchloride; polyvinylacetate; polyester; polyurethane; polyamide; epoxy resins; polyvinylbutyral; polyacrylic resins; rosin; modified rosin; terpene resins; aliphatic or aliphatic hydrocarbon resins; aromatic petroleum resins; and chlorinated paraffin, etc. These resins can be used alone or in combination and the binder resin used for the toner of the present invention is not limited thereto. Carbon black and a color pigment as well as a charge controlling agent can be optionally mixed with these resins. In addition, an additive such as silica, titanium and strontium may be included in the resins after pulverized to improve fluidity of the resultant toner.

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

The following materials were mixed and kneaded upon application of heat by a three-roll mill for five times, and the mixture was cooled and pulverized. Further, 1 part of silica per 100 parts of the pulverized mixture was included therein to prepare final toners.

A fixing test was performed for each of the toners, changing temperature of a fixer. The results were shown in Table 1.

In addition, it is unnecessary to apply an oil onto a fixing roller when using a toner including a wax, but an oil was applied to the fixing roller every time when each of the toners was tested in order to uniform the test conditions.

Example 1

| | |
|---|---|
| Cyclized polybutadiene | 60% by weight |
| trans 1,4-polybutadiene | 27% by weight |
| Carbon black | 12% by weight |
| Charge controlling agent | 1% by weight |

Example 2

| | |
|---|---|
| Cyclized polybutadiene | 40% by weight |
| trans 1,4-polybutadiene | 20% by weight |
| Magnetic material | 39% by weight |
| Charge controlling agent | 1% by weight |

Example 3

| | |
|---|---|
| Cyclized polybutadiene | 57% by weight |
| trans 1,4-polybutadiene | 24% by weight |
| Carbon black | 12% by weight |
| Charge controlling agent | 1% by weight |
| Carnauba wax | 6% by weight |

Example 4

| | |
|---|---|
| Cyclized polybutadiene | 57% by weight |
| trans 1,4-polybutadiene | 24% by weight |
| Carbon black | 12% by weight |
| Charge controlling agent | 1% by weight |
| Candelilla wax | 6% by weight |

Example 5

| | |
|---|---|
| Cyclized polybutadiene | 94% by weight |
| Carbon black | 5% by weight |
| Charge controlling agent | 1% by weight |

Example 6

| | |
|---|---|
| Cyclized polybutadiene | 74% by weight |
| trans 1,4-polybutadiene | 20% by weight |
| Cyan colorant | 5% by weight |
| Charge controlling agent | 1% by weight |

Example 7

| | |
|---|---|
| Cyclized polybutadiene | 72% by weight |
| trans 1,4-polybutadiene | 22% by weight |
| Yellow colorant | 5% by weight |
| Charge controlling agent | 1% by weight |

Example 8

| | |
|---|---|
| Cyclized polybutadiene | 42% by weight |
| Polyester resin having a high melting point (Melting point: 155° C.) | 30% by weight |
| trans 1,4-polybutadiene | 22% by weight |

-continued

| | |
|---|---|
| Carbon black | 5% by weight |
| Charge controlling agent | 1% by weight |

Example 9

| | |
|---|---|
| Cyclized polyisoprene | 78% by weight |
| Sasol H2 | 16% by weight |
| Carbon black | 5% by weight |
| Charge controlling agent | 1% by weight |

Example 10

| | |
|---|---|
| Cyclized polyisoprene | 50% by weight |
| Sasol H2 | 10% by weight |
| Magnetic material | 39% by weight |
| Charge controlling agent | 1% by weight |

Example 11

| | |
|---|---|
| Cyclized polyisoprene | 72% by weight |
| Carnauba wax | 22% by weight |
| Carbon black | 5% by weight |
| Charge controlling agent | 1% by weight |

Example 12

| | |
|---|---|
| Cyclized polyisoprene | 72% by weight |
| Montanic acid ester | 22% by weight |
| Carbon black | 5% by weight |
| Charge controlling agent | 1% by weight |

Example 13

| | |
|---|---|
| Cyclized polyisoprene | 78% by weight |
| 155 F° paraffin | 16% by weight |
| Carbon black | 5% by weight |
| Charge controlling agent | 1% by weight |

Example 14

| | |
|---|---|
| Cyclized polyisoprene | 74% by weight |
| Rice wax | 20% by weight |
| Carbon black | 5% by weight |
| Charge controlling agent | 1% by weight |

Example 15

| | |
|---|---|
| Cyclized polyisoprene | 74% by weight |
| Paraffin oxide | 20% by weight |
| Carbon black | 5% by weight |
| Charge controlling agent | 1% by weight |

Example 16

| | |
|---|---|
| Cyclized polyisoprene | 94% by weight |
| Carbon black | 5% by weight |
| Charge controlling agent | 1% by weight |

Example 17

| | |
|---|---|
| Cyclized polyisoprene | 74% by weight |
| Paraffin oxide | 20% by weight |
| Cyan | 5% by weight |
| Charge controlling agent | 1% by weight |

Example 18

| | |
|---|---|
| Cyclized polyisoprene | 72% by weight |
| Carnauba wax | 22% by weight |
| Yellow | 5% by weight |
| Charge controlling agent | 1% by weight |

Example 19

| | |
|---|---|
| Cyclized polyisoprene | 42% by weight |
| Polyester resin having a high melting point (Melting point: 155° C.) | 30% by weight |
| Carnauba wax | 22% by weight |
| Carbon black | 5% by weight |
| Charge controlling agent | 1% by weiyht |

Comparative Example 1

| | |
|---|---|
| Polyester resin having a high melting point (Melting point: 155° C.) | 94% by weight |
| Carbon black | 5% by weight |
| Charge controlling agent | 1% by weight |

Comparative Example 2

| | |
|---|---|
| Polyester resin having a low melting point (Melting point: 94° C.) | 94% by weight |

-continued

| | |
|---|---|
| Carbon black | 5% by weight |
| Charge controlling agent | 1% by weight |

TABLE 1

| | STF (° C.) | | | | | | | |
|---|---|---|---|---|---|---|---|---|
| | 60 | 70 | 80 | 90 | 100 | 120 | 140 | 160 |
| Ex. 1 | x | Δ | ○ | ○ | ○ | | | |
| Ex. 2 | x | Δ | ○ | ○ | ○ | | | |
| Ex. 3 | x | Δ | ○ | ○ | | | | |
| Ex. 4 | x | Δ | ○ | | | | | |
| Ex. 5 | | | | | | | x | ○ |
| Ex. 6 | x | x | Δ | ○ | ○ | | | |
| Ex. 7 | x | x | Δ | ○ | ○ | | | |
| Ex. 8 | x | x | Δ | ○ | ○ | | | |
| Ex. 9 | | | x | x | ○ | ○ | | |
| Ex. 10 | | | x | x | ○ | ○ | | |
| Ex. 11 | | | x | ○ | ○ | | | |
| Ex. 12 | | x | ○ | ○ | | | | |
| Ex. 13 | | x | ○ | ○ | | | | |
| Ex. 14 | | x | ○ | ○ | | | | |
| Ex. 15 | | | x | ○ | ○ | | | |
| Ex. 16 | | | | | | x | x | ○ |
| Ex. 17 | | | x | ○ | ○ | | | |
| Ex. 18 | | | x | ○ | ○ | | | |
| Ex. 19 | | | x | ○ | ○ | | | |
| Com. Ex. 1 | | | | | | x | x | ○ |
| Com. Ex. 2 | | | x | ○ | ○ | | | |

*STF: Surface temperature of fixer (° C.)
○: fixed well
Δ: narrowly fixed
x: not fixed In Example 5 in which only the cyclized polybutadiene was used, Example 16 in which only a cyclized polyisoprene was used and Comparative Example 1 in which only the polyester resin having a high melting point (155° C.) was used, the toners could not be fixed unless the fixer had a temperature not less than 160° C. In other examples in which the trans 1,4-polubutadiene and the waxes of the present invention were used, the fixing temperature of the toners could be reduced by 60 to 80° C.

A preservability test was performed using the toners. The results are shown in Table 2. (Storage environment: 2 weeks at 40° C.)

TABLE 2

| | A | B | C | D | E |
|---|---|---|---|---|---|
| Ex. 1 | ○ | −25 | −24 | 0.01 | 0.01 |
| Ex. 2 | ○ | −26 | −25 | 0.02 | 0.02 |
| Ex. 3 | ○ | −25 | −23 | 0.01 | 0.02 |
| Ex. 4 | ○ | −25 | −24 | 0.01 | 0.01 |
| Ex. 5 | ○ | −24 | −24 | 0.02 | 0.02 |
| Ex. 6 | ○ | −25 | −24 | 0.01 | 0.02 |
| Ex. 7 | ○ | −24 | −23 | 0.01 | 0.02 |
| Ex. 8 | ○ | −23 | −22 | 0.02 | 0.03 |
| Ex. 9 | ○ | −24 | −24 | 0.00 | 0.00 |
| Ex. 10 | ○ | −23 | −23 | 0.00 | 0.00 |
| Ex. 11 | ○ | −23 | −23 | 0.00 | 0.00 |
| Ex. 12 | ○ | −22 | −21 | 0.00 | 0.00 |
| Ex. 13 | ○ | −23 | −22 | 0.00 | 0.00 |
| Ex. 14 | ○ | −23 | −23 | 0.00 | 0.00 |
| Ex. 15 | ○ | −24 | −23 | 0.00 | 0.00 |
| Ex. 16 | ○ | −22 | −22 | 0.00 | 0.00 |
| Ex. 17 | ○ | −23 | −22 | 0.00 | 0.00 |
| Ex. 18 | ○ | −23 | −23 | 0.00 | 0.00 |
| Ex. 19 | ○ | −22 | −22 | 0.01 | 0.00 |
| Com. Ex. 1 | ○ | −23 | −18 | 0.03 | 0.05 |
| Com. Ex. 2 | Completely solidified | −20 | Unmeasurable | 0.03 | Unmeasurable |

*○: no change
A: Condition after storage
B: Charge quantity before storage (μc/gr)
C: Charge quantity after storage (μc/gr)
D: Photoreceptor contamination before storage
E: Photoreceptor contamination after storage The charge quantity is charge quantity of the toner on a developing sleeve using a one-component developer.

The photoreceptor contamination was examined as follows:

(1) the toner adhered onto the surface of a photoreceptor was taken with a transparent adhesive tape and the tape was stuck on a white paper, and the density was measured by a Macbeth densitometer; and (2) the transparent adhesive tape without toner was stuck on a white paper and the density was measured in the same manner, and the difference of the density was calculated.

The smaller the value, the less contamination of the photoreceptor.

As shown in Table 2, although the toners had low melting points due to the cyclized polybutadiene; and the trans 1,4-polybutadiene and the waxes of the present invention, the preservability and properties thereof did not change. Even the toner including an ordinary polyester resin having a high melting point had no problem in its preservability and properties although the properties slightly changed. However, the toner including a polyester resin having a low melting point was completely solidified and even its properties could not be measured.

A running test was performed using the toners (2,000 images were produced), in which a one-component developer was used. The results are shown in Table 3 and the charge quantity is charge quantity of the toner on a developing sleeve.

TABLE 3

| | F | G | H | I |
|---|---|---|---|---|
| Ex. 1 | −25 | −25 | 0.01 | 0.01 |
| Ex. 2 | −26 | −24 | 0.00 | 0.01 |
| Ex. 3 | −25 | −24 | 0.01 | 0.02 |
| Ex. 4 | −25 | −24 | 0.01 | 0.01 |
| Ex. 5 | −24 | −24 | 0.01 | 0.01 |
| Ex. 6 | −25 | −24 | 0.01 | 0.01 |
| Ex. 7 | −24 | −23 | 0.01 | 0.01 |
| Ex. 8 | −23 | −22 | 0.02 | 0.04 |
| Ex. 9 | −24 | −24 | 0.00 | 0.01 |
| Ex. 10 | −23 | −23 | 0.00 | 0.01 |
| Ex. 11 | −23 | −23 | 0.00 | 0.01 |
| Ex. 12 | −22 | −21 | 0.00 | 0.01 |
| Ex. 13 | −23 | −22 | 0.00 | 0.01 |
| Ex. 14 | −23 | −23 | 0.00 | 0.01 |
| Ex. 15 | −24 | −23 | 0.00 | 0.01 |
| Ex. 16 | −22 | −22 | 0.00 | 0.01 |
| Ex. 17 | −23 | −22 | 0.00 | 0.01 |
| Ex. 18 | −23 | −23 | 0.00 | 0.01 |
| Ex. 19 | −22 | −22 | 0.01 | 0.01 |
| Com. Ex. 1 | −23 | −15 | 0.01 | 0.06 |
| Com. Ex. 2 | −20 | −10 | 0.01 | 0.12 |

F: Initial charge quantity (μc/gr)
G: Charge quantity after 2,000 images were produced (μc/gr)
H: Initial photoreceptor contamination
I: Photoreceptor contamination after 2,000 images were produced As shown in Table 3, the toners including the cyclized polybutadiene or rubber alone; or a combination of the cyclized polybutadiene or rubber and the trans 1,4-polubutadiene or the waxes of the present invention scarcely changed in the charge quantity and the photoreceptor contamination. The toner including a combination of the cyclized polybutadiene and the polyester resin having a high melting point had a slight change of the charge quantity and slight deterioration of the photoreceptor contamination, which was not a significant problem. The toner including the polyester resin having a high melting point alone had deterioration of the charge quantity and the photoreceptor contamination, which was still usable. The toner including the polyester resin having a low melting point had significant deterioration of the charge quantity and the photoreceptor contamination, which was unusable.

In addition, toner spent, filming and adherence test was performed. A two-component developer was used in the toner-spent test and a one-component developer was used in the test of toner filming over a developing sleeve and adherence to a developing blade. After 2,000 images were respectively produced with each developer, conditions of the toner spent, filming and adherence were evaluated. The results are shown in Table 4

TABLE 4

| | Spent | Filming | Adherence |
|---|---|---|---|
| Ex. 1 | 1 | 1 | 1 |
| Ex. 2 | 1 | 1 | 1 |
| Ex. 3 | 1 | 1 | 1 |
| Ex. 4 | 1 | 1 | 1 |
| Ex. 5 | 1 | 1 | 1 |
| Ex. 6 | 1 | 1 | 1 |
| Ex. 7 | 1 | 1 | 1 |
| Ex. 8 | 1 | 2 | 1 |
| Ex. 9 | 1 | 1 | 1 |
| Ex. 10 | 1 | 1 | 1 |
| Ex. 11 | 1 | 1 | 1 |
| Ex. 12 | 1 | 1 | 1 |
| Ex. 13 | 1 | 1 | 1 |
| Ex. 14 | 1 | 1 | 1 |
| Ex. 15 | 1 | 1 | 1 |
| Ex. 16 | 1 | 1 | 1 |
| Ex. 17 | 1 | 1 | 1 |
| Ex. 18 | 1 | 1 | 1 |
| Ex. 19 | 1 | 2 | 1 |
| Com. Ex. 1 | 2 | 2 | 2 |
| Com. Ex. 2 | 3 | 3 | 3 |

1: did not occur
2: slightly occurred, but no problem in practical use
3: occurred and unusable because produced images were significantly deteriorated The toners including the cyclized polybutadiene or rubber; or a combination of the cyclized polybutadiene or rubber and the trans 1,4-polybutadiene or the waxes of the present invention scarcely had a change between the initial quality and the quality after 2,000 images were produced. The toner including a combination of the cyclized polybutadiene or rubber and the polyester resin having a high melting point had slight toner filming over a developing roller, but the produced images had no problem. The toner including only the polyester having a high melting point had slight toner spent on a carrier in the two-component developer, and slight toner filming over a developing roller and adherence to a developing blade. However, this was not a significant problem and was conventional quality. The toner including only the polyester having a low melting point had considerable toner spent when the two-component developer was used, and considerable toner filming over a developing sleeve and adherence to a developing blade when the one-component developer was used. This toner was unusable since the produced images had many defects such as image density irregularity, background fouling and white streaks.

Next, quality of printed images printed by both a single-sided and a double-sided printing methods were examined. The results are shown in Table 5.

TABLE 5

| | Single-sided printing | Double-sided printing | Remarks |
|---|---|---|---|
| Ex. 1 | 1 | 1 | |
| Ex. 2 | 1 | 1 | |
| Ex. 3 | 1 | 1 | |
| Ex. 4 | 1 | 1 | |
| Ex. 5 | 1 | 1 | |
| Ex. 6 | 1 | 1 | |
| Ex. 7 | 1 | 1 | |
| Ex. 8 | 1 | 1 | |
| Ex. 9 | 1 | 1 | |
| Ex. 10 | 1 | 1 | |
| Ex. 11 | 1 | 1 | |
| Ex. 12 | 1 | 1 | |
| Ex. 13 | 1 | 1 | |
| Ex. 14 | 1 | 1 | |
| Ex. 15 | 1 | 1 | |
| Ex. 16 | 1 | 1 | |
| Ex. 17 | 1 | 1 | |
| Ex. 18 | 1 | 1 | |
| Ex. 19 | 1 | 1 | |
| Com. Ex. 1 | 1 | 1 | |
| Com. Ex. 2 | 2 | 3 | Back side of an adjacent paper was slightly contaminated in the singe–sided printing method. A blocking problem occurred since the toners on the surface of a paper and on the backside of an adjacent paper were fused. |

1: good
2: not good and not poor
3: poor

The toner including the polyester resin having a low melting point in Comparative Example 2 was unusable since the receiving paper was contaminated and blocking problem occurred.

Further, pulverizingprocess to form a toner was evaluated. A time for forming a certain amount of toner having a desired particle diameter and a condition of adherence thereof are shown in Table 6.

TABLE 6

| | Pulverizing time (hrs) | Toner adherence in a pulverizing room | Remarks |
|---|---|---|---|
| Ex. 1 | 0.75 | ○ | |
| Ex. 2 | 0.75 | ○ | |
| Ex. 3 | 0.25 | ○ | |
| Ex. 4 | 0.25 | ○ | |
| Ex. 5 | 0.75 | ○ | |
| Ex. 6 | 0.75 | ○ | |
| Ex. 7 | 0.75 | ○ | |
| Ex. 8 | 0.50 | ○ | |
| Ex. 9 | 0.25 | ○ | |
| Ex. 10 | 0.25 | ○ | |
| Ex. 11 | 0.25 | ○ | |
| Ex. 12 | 0.25 | ○ | |
| Ex. 13 | 0.25 | ○ | |
| Ex. 14 | 0.25 | ○ | |
| Ex. 15 | 0.25 | ○ | |
| Ex. 16 | 0.25 | ○ | |
| Ex. 17 | 0.25 | ○ | |
| Ex. 18 | 0.25 | ○ | |
| Ex. 19 | 0.50 | ○ | |
| Com. Ex. 1 | 0.75 | ○ | |

TABLE 6-continued

| | Pulverizing time (hrs) | Toner adherence in a pulverizing room | Remarks |
|---|---|---|---|
| Com. Ex. 2 | 2.00 | X | The toner was accumulated on a collision board in the pulverizing room like a stalagmite |

The toners of Examples 1 to 19 and Comparative Example 1 had no problem in the pulverizing process. In addition, a time for pulverizing the toners including a wax becomes short. However, a time for pulverizing the toner including the polyester resin having a low melting point of Comparative Example 2 was not less than twice as long as an ordinary time. In addition, toner adherence in the pulverizing room was so bad that the pulverizing condition had to be changed. Therefore, the toner including the polyester resin having a low melting point had a problem in the process of forming the toner.

This document claims priority and contains subject matter related to Japanese Patent Applications Nos. JPAP2001-191326 and JPAP2001-132836, filed on Jun. 25, 2001 and April 27, 2001, respectively, incorporated herein by reference.

Having now fully described the invention, it will be apparent to one of ordinary skill in the art that many changes and modifications can be made thereto without departing from the spirit and scope of the invention as set forth therein.

What is claimed as new and desired to be secured by Letters Patent of the United States is:

1. A toner comprising:

a colorant; and a binder, wherein the binder comprises a cyclized polybutadiene and trans 1,4-polybutadiene.

2. The toner of claim 1, wherein the cyclized polybutadiene is mixed with the trans 1,4-polybutadiene at a temperature not lower than a melting point of the trans 1,4-polybutadiene.

3. The toner of claim 1, wherein the cyclized polybutadiene is included in the toner in an amount not less than 10% of total weight of the binder.

4. The toner of claim 1, wherein a weight ratio (A/B) of the cyclized polybutadiene (A) to the trans 1,4-polybutadiene (B) is from 97/3 to 5/95.

5. The toner of claim 1, wherein the melting point of the trans 1,4-polybutadiene is lower than a melting point of the cyclized polybutadiene.

6. The toner of claim 1, wherein the cyclized polybutadiene has a cyclization ratio not less than 40%.

7. The toner of claim 1, wherein the trans 1,4-polybutadiene has a purity not less than 60%.

8. The toner of claim 1, further comprising a first wax, wherein a weight ratio (C/D) of the first wax (C) to the binder (D) is from 1/99 to 50/50.

9. The toner of claim 8, wherein the first wax has a penetration of from 0 to 20 at a temperature of 25° C.

10. The toner of claim 1, wherein the binder further comprises a second wax, and wherein the cyclized polybutadiene is mixed with the second wax at a temperature not lower than a melting point of the second wax.

11. The toner of claim 10, wherein a weight ratio (A/E) of the cyclized polybutadiene (A) to the second wax (E) is from 97/3 to 5/95.

12. The toner of claim 10, wherein the melting point of the second wax is lower than a melting point of the cyclized polybutadiene.

13. The toner of claim 10, wherein the second wax has a purity not less than 60%.

14. The toner of claim 10, wherein the second wax has a melting viscosity of from 1 to 10,000,000 at a temperature of 150° C.

15. The toner of claim 10, wherein the second wax has a penetration of from 0 to 20 at a temperature of 25° C.

16. The toner of claim 10, wherein the second wax comprises a wax selected from the group consisting of paraffin waxes, microcrystalline waxes, olefin waxes and oxides of the waxes.

17. An image forming method comprising:

irradiating an image bearer with light to form an electrostatic latent image on the image bearer;

developing the electrostatic latent image with a toner to form a toner image on the image bearer;

transferring the toner image onto a receiving material; and fixing the toner image on the receiving material upon application of heat, wherein the toner is a toner comprising:

a colorant; and a binder, wherein the binder comprises a cyclized polybutadiene and trans 1,4-polybutadiene.

18. The image forming method of claim 17, wherein the cyclized polybutadiene is mixed with the trans 1,4-polybutadiene at a temperature not lower than a melting point of the trans 1,4-polybutadiene.

19. The image forming method of claim 17, wherein the binder further comprises a second wax, and wherein the cyclized polybutadiene is mixed with the second wax at a temperature not lower than a melting point of the second wax.

20. The image forming method of claim 17, wherein the cyclized polybutadiene is included in the toner in an amount not less than 10% of total weight of the binder.

21. The image forming method of claim 17, wherein a weight ratio (A/B) of the cyclized polybutadiene (A) to the trans 1,4-polybutadiene (B) is from 97/3 to 5/95.

22. The image forming method of claim 17, wherein the melting point of the trans 1,4-polybutadiene is lower than a melting point of the cyclize polybutadiene.

23. The image forming method of claim 17, wherein the cyclized polybutadiene has a cyclization ratio not less than 40%.

24. The image forming method of claim 17, wherein the trans 1,4-polybutadiene has a purity not less than 60%.

25. The image forming method of claim 17, further comprising a first wax, wherein a weight ratio (C/D) of the first wax (C) to the binder (D) is from 1/99 to 50/50.

26. The image forming method of claim 25, wherein the first wax has a penetration of from 0 to 20 at a temperature of 25° C.

27. The image forming method of claim 17, wherein the binder further comprises a second wax, and wherein the cyclized polybutadiene is mixed with the second wax at a temperature not lower than a melting point of the second wax.

28. The image forming method of claim 27, wherein a weight ratio (A/E) of the cyclized polybutadiene (A) to the second wax (E) is from 97/3 to 5/95.

29. The image forming method of claim 27, wherein the melting point of the second wax is lower than a melting point of the cyclized polybutadiene.

30. The image forming method of claim 27, wherein the second wax has a purity not less than 60%.

31. The image forming method of claim 27, wherein the second wax has a melting viscosity of from 1 to 10,000,000 at a temperature of 150° C.

32. The image forming method of claim 27, wherein the second wax has a penetration of from 0 to 20 at a temperature of 25° C.

33. The image forming method of claim 27, wherein the second wax comprises a wax selected from the group consisting of paraffin waxes, microcrystalline waxes, olefin waxes and oxides of the waxes.

34. An image forming apparatus comprising:

an image bearer;

an irradiator configured to irradiate the image bearer to form an electrostatic latent image on the image bearer;

an image developer configured to develop to electrostatic latent image with a toner to form a toner image on the image bearer;

a transferer configured to transfer the toner image onto a receiving material; and a fixer configured to fix the toner image on the receiving material upon application of heat, wherein the toner is a toner comprising:

a colorant; and a binder, wherein the binder comprises a cyclized polybutadiene and trans 1,4-polybutadiene.

35. The image forming apparatus of claim 34, wherein the cyclized polybutadiene is mixed wit the trans 1,4-polybutadiene at a temperature not lower than a melting point of the trans 1,4-polybutadiene.

36. The image forming apparatus of claim 34, wherein the binder further comprises a second wax, and wherein the cyclized polybutadiene is mixed with the second wax at a temperature not lower than a melting point of the second wax.

37. The image forming apparatus of claim 34, wherein the cyclized polybutadiene is included in the toner in an amount not less than 10% of total weight of the binder.

38. The image forming apparatus of claim 34, wherein a weight ratio (A/B) of the cyclized polybutadiene (A) to the trans 1,4-polybutadiene (B) is from 97/3 to 5/95.

39. The image forming apparatus of claim 34, wherein the melting point of the trans 1,4-polybutadiene is lower than a melting point of the cyclized polybutadiene.

40. The image forming apparatus of claim 34, wherein the cyclized polybutadiene has a cyclization ratio not less than 40%.

41. The image forming apparatus of claim 34, wherein the trans 1,4-polybutadiene has a purity not less than 60%.

42. The image forming apparatus of claim 34, further comprising a first wax, wherein a weight ratio (C/D) of the first wax (C) to the binder (D) is from 1/99 to 50/50.

43. The image forming apparatus of claim 42, wherein the first wax has a penetration of from 0 to 20 at a temperature of 25° C.

44. The image forming apparatus of claim 34, wherein the binder further comprises a second wax, and wherein the cyclized polybutadiene is mixed with the second wax at a temperature not lower than a melting point of the second wax.

45. The image forming apparatus of claim 42, wherein a weight ratio (A/E) of the cyclized polybutadiene (A) to the second wax (E) is from 97/3 to 5/95.

46. The image forming apparatus of claim 42, wherein the melting point of the second wax is lower than a melting point of the cyclized polybutadiene.

47. The image forming apparatus of claim 42, wherein the second wax has a purity not less than 60%.

48. The image forming apparatus of claim 42, wherein the second wax has a melting viscosity of from 1 to 10,000,000 at a temperature of 150° C.

49. The image forming apparatus of claim 42, wherein the second wax has a penetration of from 0 to 20 at a temperature of 25° C.

50. The image forming apparatus of claim 42, wherein the second wax comprises a wax selected from the group consisting of paraffin waxes, microcrystalline waxes, olefin waxes and oxides of the waxes.

* * * * *